US007987988B2

(12) United States Patent
Johnson et al.

(10) Patent No.: US 7,987,988 B2
(45) Date of Patent: Aug. 2, 2011

(54) DISPLAY CASE FOR RIBBON SUSPENDED MEDAL(S)

(76) Inventors: Carter Cue Johnson, Charlotte, NC (US); William Masten Carter, III, Charlotte, NC (US)

( * ) Notice: Subject to any disclaimer, the term of this patent is extended or adjusted under 35 U.S.C. 154(b) by 0 days.

(21) Appl. No.: 12/928,332

(22) Filed: Dec. 9, 2010

(65) Prior Publication Data

US 2011/0147236 A1 Jun. 23, 2011

Related U.S. Application Data

(60) Provisional application No. 61/284,334, filed on Dec. 17, 2009.

(51) Int. Cl.
*B65D 25/54* (2006.01)

(52) U.S. Cl. ..... 206/756; 206/769; 206/776; 206/6.1; 220/256.1

(58) Field of Classification Search ..... 206/775, 206/776, 777, 778, 779, 780, 781, 782, 783, 206/457, 769, 770, 771, 772, 45.28, 756, 206/6.1; 220/255, 256.1, 257.2
See application file for complete search history.

(56) References Cited

U.S. PATENT DOCUMENTS

| | | | | |
|---|---|---|---|---|
| 2,778,487 | A * | 1/1957 | Raeburn | 206/459.5 |
| 3,792,543 | A * | 2/1974 | Powell | 40/800 |
| 5,058,733 | A * | 10/1991 | Lowe | 206/281 |
| 5,292,003 | A * | 3/1994 | Baghdassarian | 206/575 |
| 6,422,411 | B1 * | 7/2002 | Gray | 220/254.2 |
| 2002/0145365 | A1 * | 10/2002 | Johnson et al. | 312/114 |
| 2005/0006390 | A1 * | 1/2005 | Wang | 220/326 |
| 2007/0039849 | A1 * | 2/2007 | Rodriguez | 206/457 |
| 2009/0152140 | A1 * | 6/2009 | Kim | 206/293 |

* cited by examiner

*Primary Examiner* — Jacob K Ackun

(57) ABSTRACT

A display case comprised of a lid and a case is provided to showcase a ribbon suspended medal or multiple ribbon suspended medals in a cube-like enclosure made of transparent, semi-transparent, and/or opaque material of all components or selected components with the ribbon suspended medal(s) inside the enclosure and protected by the material. The ribbon suspended medal(s) is held by a multiple component lid with the ribbon(s) wound or bound in various fashions within the void area of the lid hence fully enclosed by the case but visible from all transparent sides. The features of the case allow for vertical expansion of the display cases by way of stacking features on the outside top and outside bottom which are used to affix stacked units securely in place.

2 Claims, 6 Drawing Sheets

DISPLAY CASE FOR RIBBON SUSPENDED MEDAL(S)

CROSS-REFERENCE TO RELATED APPLICATIONS

The present application derives priority from U.S. Provisional Application No. 61/284,334 for "Multiple component constructed lid used for hanging ribbon suspended medal(s) while used in conjunction with stackable case"; filed Dec. 17, 2009; Inventors: Johnson, Carter Cue; Carter III, William Masten.

BACKGROUND OF THE INVENTION

1. Field of the Invention

The present invention relates generally to display cases, and more specifically to showcases used to display ribbon suspended medals.

2. Background of the Invention

Upon completion of contests, events, service, and ceremonies (including but not exclusive to athletic competitions) noted participants, finishers, contestants, individuals, and groups are presented with one ribbon suspended medal or multiple ribbon suspended medals to commemorate and recognize the occasion, feats, and/or accomplishments.

Typical presentation of the ribbon suspended medal or medals involves the presenter placing the center void area of the looped ribbon over the recipient's head so the ribbon suspended medal hangs around the recipient's neck. This allows the medal to be displayed prominently on the recipient's chest region. However, since wearing the medal around the neck is not a practical long term placement solution to display the medal other options have been created.

In the absence of discovering an appealing option to display a ribbon suspended medal or multiple ribbon suspended medals, the recipient may select a location to place and store them in a non-display area such as inside a closed drawer, inside a closed jewelry box, or in other locations where the medal(s) is not visible. Likewise, the recipient also may choose to casually hang the ribbon suspended medal(s) on an available household doorknob, such as those doorknobs used to open closet doors. Ultimately this option may be considered as an unattractive and/or impractical solution to display the medal(s).

The articles of manufacture that exist as options to showcase an awarded ribbon suspended medal or medals have been largely limited to wall mounted options and/or peg extended hanging options affixed to walls or vertical surfaces.

The present invention is directed to enhancing the display of a ribbon suspended medal or medals by encompassing many desirable features for effective display: visual appeal, ease of use, ability to display multiple medals within one unit, secure binding of the ribbon suspended medal(s), and expandability of the entire display.

3. Description of Prior Art

Related U.S. Patent Classifications with relevance to the present article of manufacture: Class 312/114; Class 40/800; Class 211/85.2; Class 248.

U.S. Pat. No. 6,328,171 to Coppel shows an invention that holds and displays ribbon suspended medals by means of a display board having slots, aperture pairs, and a hook clip. This board invention has complex fastening devices and exposes the medals to dust and other undesirable elements. This board invention requires an additional supporting stand be added in order to be displayed on a horizontal surface. The medals are not visible from all sides. The board display is not vertically expandable.

U.S. Pat. No. 6,817,129 to Purdy is a plaque-like frame with a functional cavity for the ribbon to remain attached and concealed while displaying the medallion. This plaque invention requires an additional supporting stand be added in order to display the unit on a horizontal surface. It is described as a wall mounted plaque. It is designed to be used with only one medal and no additional medals on display within the same unit. The medal is not visible from all sides while on display in this plaque invention and this plaque invention is not vertically expandable.

U.S. Pat. No. 6,793,297 to Johnson is an invention that is comprised of a slotted display panel positioned between a primary back panel and a front clear viewing panel. This slotted panel invention is made to hang on a vertical surface much like a picture frame and it requires an additional supporting stand be added in order to display the unit on a horizontal surface. This slotted panel invention has a complex ribbon fastening device that requires the ribbons be inserted into slots. This slotted panel invention can accommodate one or more medals, however, if only one medal is displayed in this invention, all of the other empty slots and empty spaces remain visible and unsightly. The medals are not visible from all sides in this slotted panel invention and this slotted panel invention is not vertically expandable as a surface top option.

U.S. Pat. No. 5,353,921 to Tyra is a briefcase style design insignia case that allows the medals to only be visible while the case is unlatched and in the open position with the hinged top open. It is made to primarily house and display medals with fastening pins or stick pins. The medals are not visible from all sides of this briefcase invention and this briefcase invention is not vertically expandable. None of the material of this briefcase invention is transparent.

U.S. Pat. No. 5,118,171 to Ortiz is a wall mounted invention that is primarily for displaying headgear along with additional memorabilia. This is not a surface top display. The displayed items are not visible from all sides in this headgear display invention and this headgear display invention is not vertically expandable as a surface top display option.

Limited options exist to display a medal or medals in a surface top free standing method. The most notable is the shadow box style display. A shadow box is much like a picture frame but with a greater front to back dimension if measured in that direction while it is wall mounted allowing the inner cavity to be larger but with still only one surface being transparent. Usually the shadow box style does not allow the medal or medals to hang freely. The displayed items are not visible from all sides of the display. The shadow box is not made to be vertically expandable but to be used as a singular unit. Any attempt to expand the shadow box display by stacking them would result in an unstable or non-locking stacking of the units.

Another method for hanging ribbon suspended medal(s) is the use of a tie rack. The ribbons and medals are free hanging and not contained within a structure of any kind. The tie rack is an impractical option to attractively display and protect ribbon suspended medals.

Another method for hanging ribbon suspended medals is the use of an available doorknob to hang the medals. The use of a doorknob is an impractical option to attractively display and protect ribbon suspended medals.

SUMMARY OF THE INVENTION

It is an object of the present invention to provide a showcase for a ribbon suspended medal or medals that is easy to use as an attractive display.

It is another object to enclose the ribbon suspended medal(s) within components of which the material can be any combination of transparent, semi-transparent, and/or opaque materials.

It is yet another object to wrap the ribbons around a structure and allow the medal(s) to be viewed in suspension with the medal(s) hanging toward the direction of the pull of gravity.

It is yet another object to provide a display case that can be used on a horizontal surface top such as a desk, book shelf, table, mantle, etc.

It is yet another object to provide a display case that has features on the outer top edges and outer bottom edges which will allow the display case to be locked in place with additional like cases as they are stacked in a vertical direction.

The advantages of the present invention are: its ease of use, its use as a surface top display without the need to add or attach additional supporting devices for it to be used on a horizontal surface, its ability to fully contain the contents which aids in protecting the displayed items from wear and tear and undesirable elements such as dust, its transparent construction allowing the contents to be viewed from any side and any angle where transparency or semi-transparency exists, its ribbon supporting structure that is quick and easy to use to wind and bind the ribbon or ribbons without complex fastening devices, its stacking features that allow it to be vertically expandable, and its stacking features that allow it to be stacked in a stable fashion.

BRIEF DESCRIPTION OF DRAWINGS

Specific embodiments of the invention and other objects and advantages included in the invention will be apparent from the following description taken in connection with the accompanying drawings, in which.

DETAILED DESCRIPTION OF INVENTION

The present invention is an article of manufacture which can be made by hand or machine and is relatively simple with few moving parts.

Figure 1:
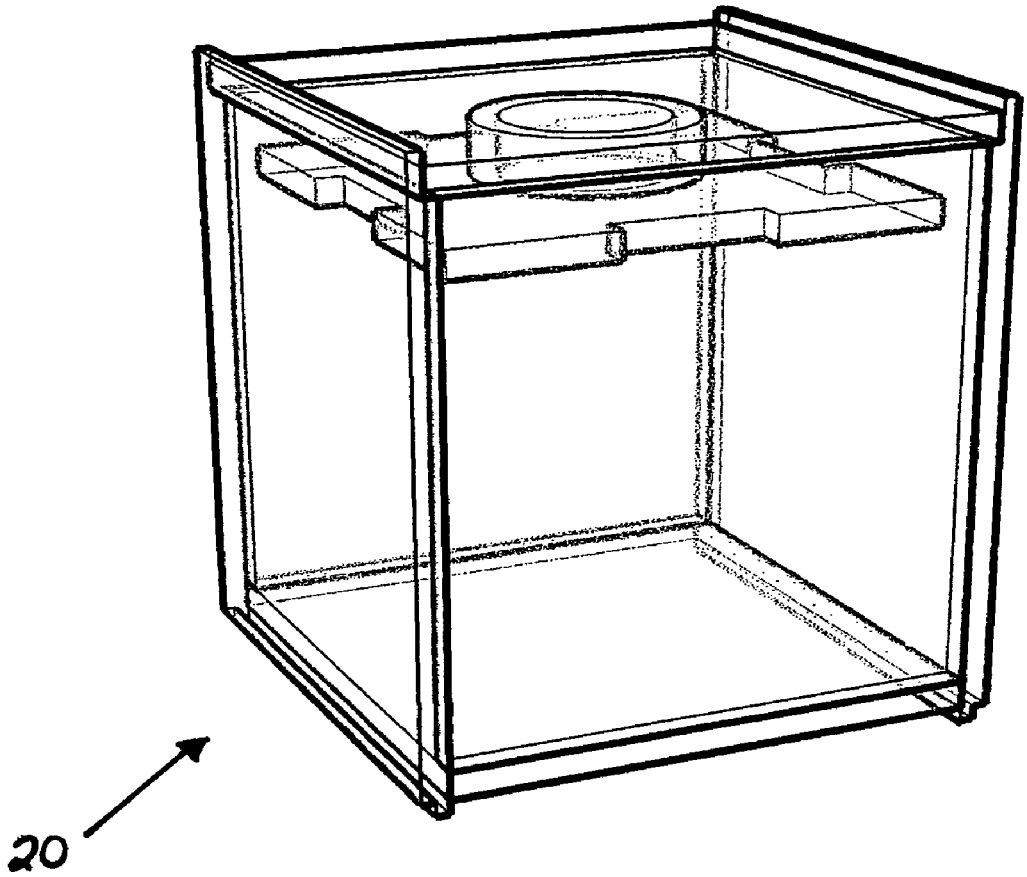
FIG. 1 is a front perspective view of a display case for ribbon suspended medal(s) according to the present invention.

All components and parts described in the body of this specification for the present invention as depicted in FIG. 1 item 20 for a predetermined shape and size and thickness can be made from wholly transparent material such as but not limited to acrylic and/or plastic and/or glass, etc. with any combination of partially transparent material or opaque material such as but not limited to metal and/or wood and/or plastic, etc. comprising any of the components of present invention.

The whole or in part components may be made to predetermined specifications by fabrication with hand tools, machinery similar to wood working equipment and/or laser cutting devices from existing sheets and/or material and/or by injection molded process and where necessary component or components will be joined in a manner consistent with customary joining type or process appropriate for corresponding material.

The components will be cleaned, buffed, and prepared for the converting and assembly process where necessary.

Figure 2:
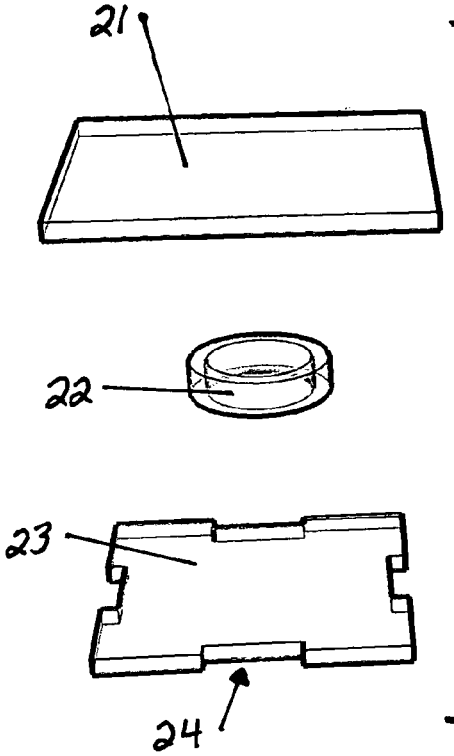
FIG. 2 is an exploded perspective front view of a display case for ribbon suspended medal(s) lid showing the disposition of various visible components.

FIG. 2 item 21 shows the top layer/support sheet which functions to prevent the completed lid from dropping partially or fully into the void area of the open top case. Item 22 shows the spacer which is depicted as a cylinder or tube but may also be a predetermined shape with predetermined diameter and predetermined thickness existing with a cavity or in solid form without a cavity. Item 23 depicts the lower layer/hanger sheet with predetermined features called notched/cut-out areas 24 that function to help maintain the position of the ribbon suspended medal(s) when the ribbon suspended medal or medals are placed/wrapped/affixed to the lid and/or spacer.

Figure 3:
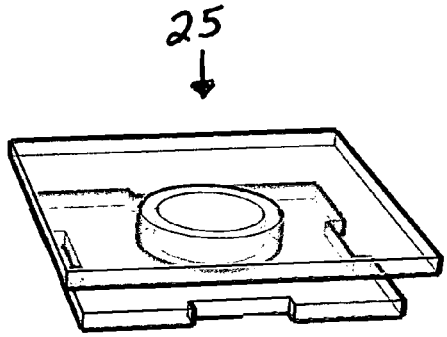
FIG. 3 is a perspective front view of assembled lid for the display case for ribbon suspended medal(s).

FIG. 3 item 25 depicts the final joined or injection molded in part or in total component or components to be defined as the lid. The spacer 22 when joined with the top layer/support sheet 21 and the lower layer/hanger sheet 23 results in the creation of the void area around the spacer and between the layers/sheets as shown in item 25 and this is where the ribbon is to be wrapped/woven/tied/wound/bound.

Figure 4:
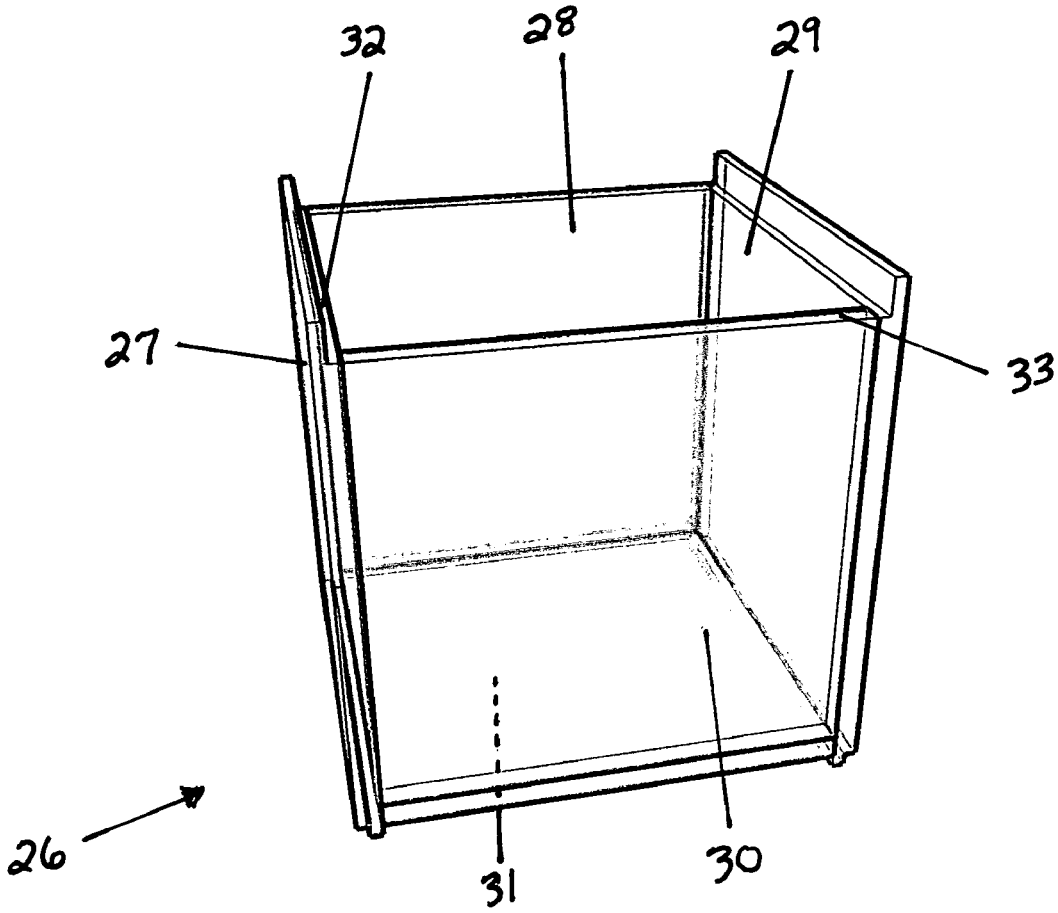
FIG. 4 is a front perspective view of the display case for ribbon suspended medal(s) without lid.

FIG. 4 item 26 depicts the final joined or injection molded in part or in total component or components to be defined as case. Items 27, 28, 29, 30, and 31 depict the fixed sides and bottom of the case which are joined in part or created in total to create a contained compartment enclosed on multiple sides. Items 32 and 33 depict predetermined top edges defined as ledges.

Figure 5:
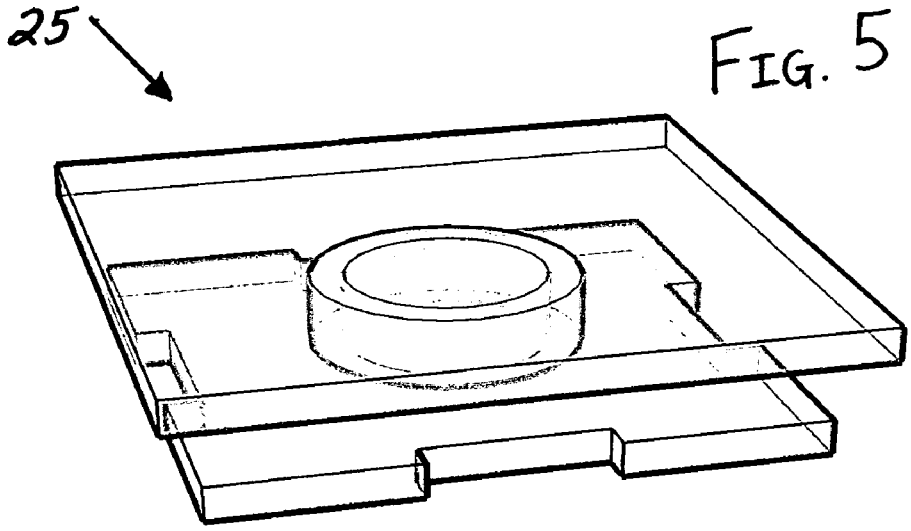
FIG. 5 is same as FIG. 3 but shown in relation to FIG. 4.
Figure 6:
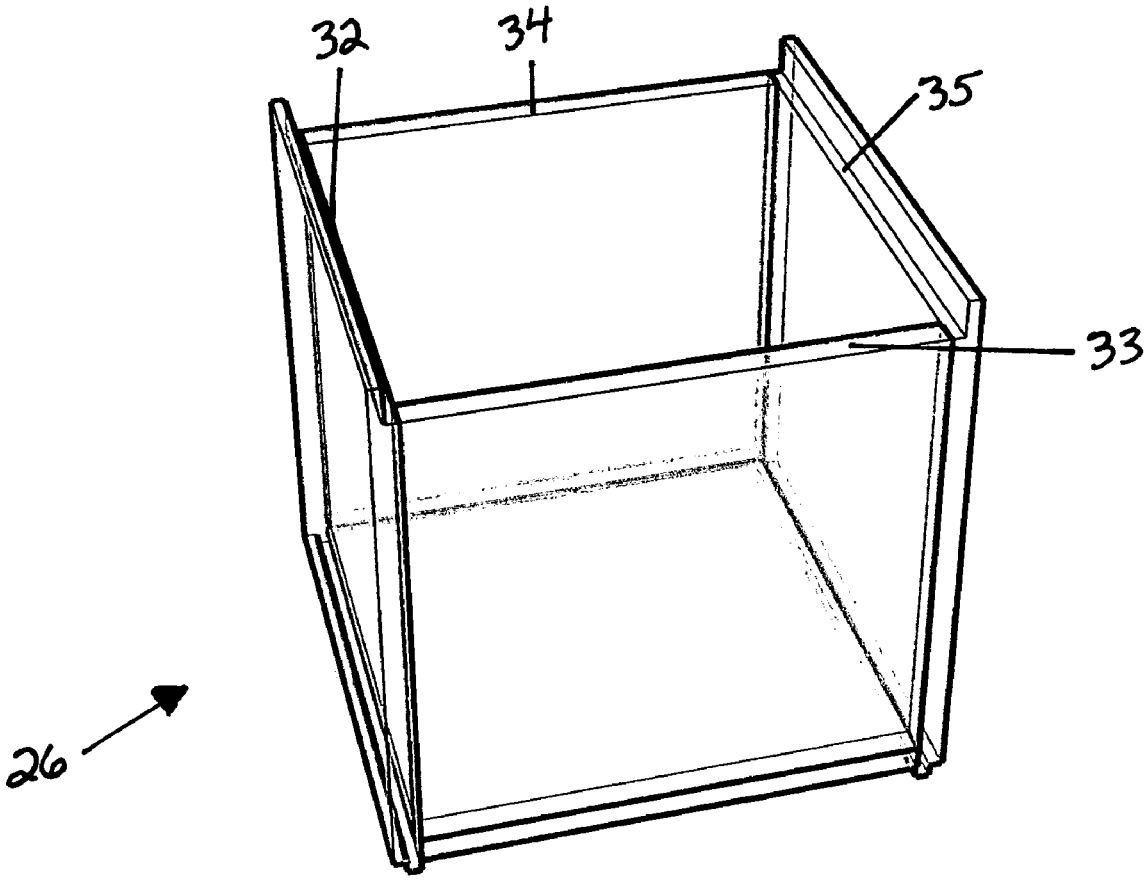
FIG. 6 is same as FIG. 4 but shown in relation to FIG. 3.

FIG. 5 item 25 depicts the lid. The lid can be lifted from the case for the ribbon suspended medal(s) to be wound or affixed, pivoted, and then placed to fit in any symmetrical direction with the outer edges of the lid being supported by the 32, 33, 34, 35 ledges created by the top surface of the sides of the FIG. 6 case 26. The lid in its preferred embodiment is omni directional meaning it will fit and function in any direction when symmetrically made and where the exposed surface of the top sheet/support layer of the lid is upward facing and the lower sheet/hanger sheet is located inside the void area of the case. The larger size of the top layer/support sheet 21 functions to keep the lid suspended above the void area of the case so as to keep it from dropping into the void area of the case 26 by resting on the ledges 32, 33, 34, 35. As the lid is placed on the case, the smaller dimensions of the lower layer/hanger sheet 23 allow it to fit into the void area of the case and only move slightly in any lateral direction which will prevent the top layer/support sheet from being placed in a manner that would introduce the presence of a gap opening between the lid and the case. In addition, the smaller size of the lower layer/hanger sheet will not be affected by the ribbon overlapping any outer edge of said sheet and therefore affect the normal function of the lid meaning that if the ribbon has overlapped an edge or edges of the lower layer/hanger sheet the lid will still fit on the case even with this additional material adding unexpected thickness to the lower layer/hanger sheet side edges.

Figure 7:
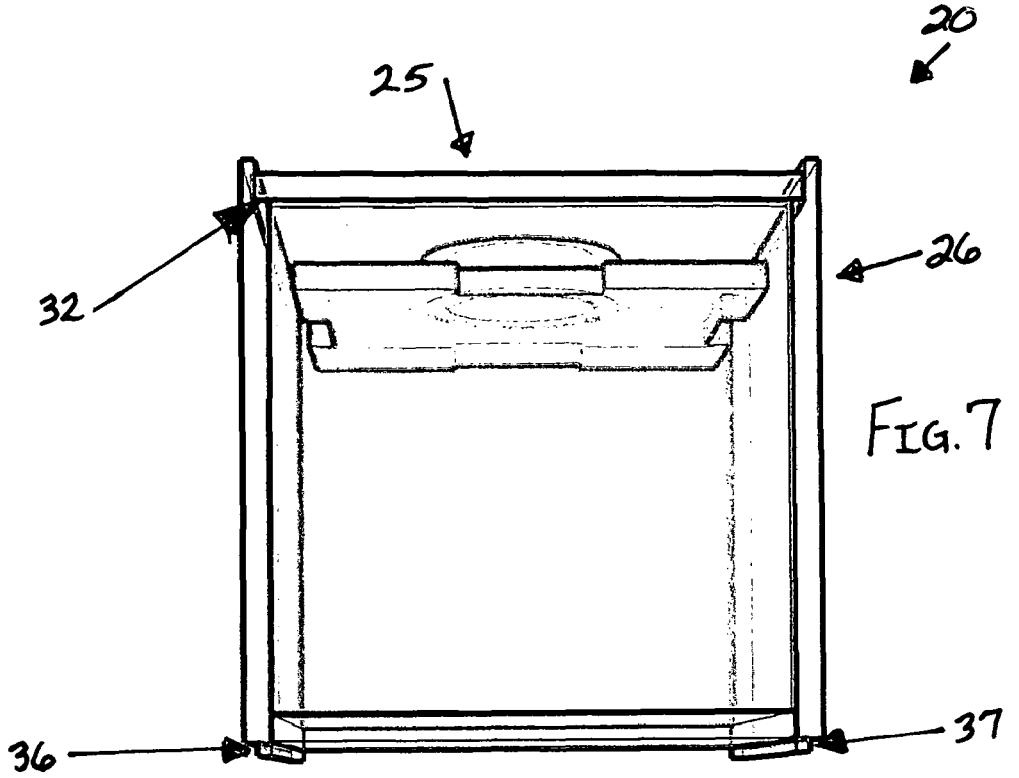
FIG. 7 is a front elevation view of the display case for ribbon suspended medal(s) shown above and in relation to an additional present invention when used as vertical expansion of the entirety of display for ribbon suspended medal(s).
Figure 8:
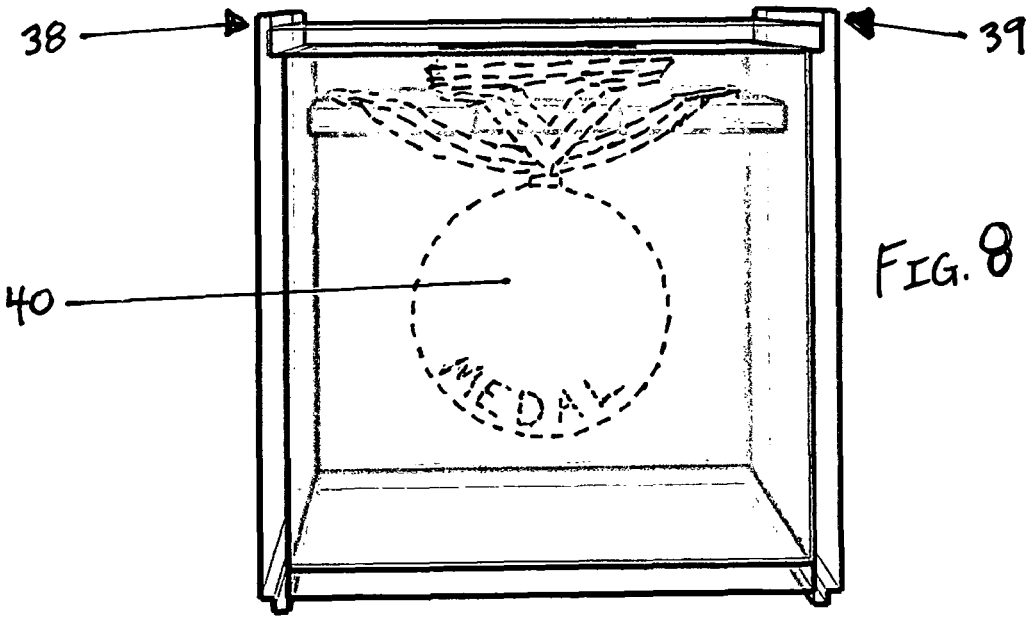
FIG. 8 is a front elevation view of the display case for ribbon suspended medal(s) shown below and in relation to an additional present invention when used as vertical expansion of the entirety of display for ribbon suspended medal(s).

FIG. 7 depicts the present invention 20 as a combination of the lid 25 and the case 26. It also shows the lid 25 resting on the ledge 32 which is the top surface of the side. FIG. 7 item 36 and item 37 depict the inner locking notches on the bottom of present invention in relation to the corresponding outer locking notches FIG. 8 item 38 and item 39 on the top of the present invention when two units of the present invention are used in conjunction to create a vertically stacked display of multiple display cases for ribbon suspended medals. FIG. 8 item 40 shows a supplied ribbon suspended medal which has been wound, bound, and/or affixed to the spacer and hanger sheet of the lid.

Figure 9:
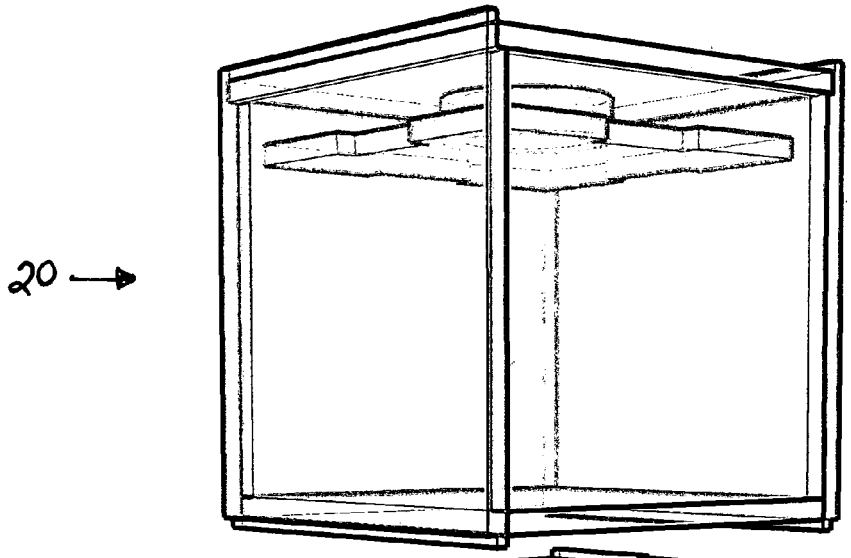
FIG. 9 is a corner perspective view of the display case for ribbon suspended medal(s) shown above and in relation to additional present invention when used as vertical expansion of the entirety of display for ribbon suspended medal(s).
Figure 10:
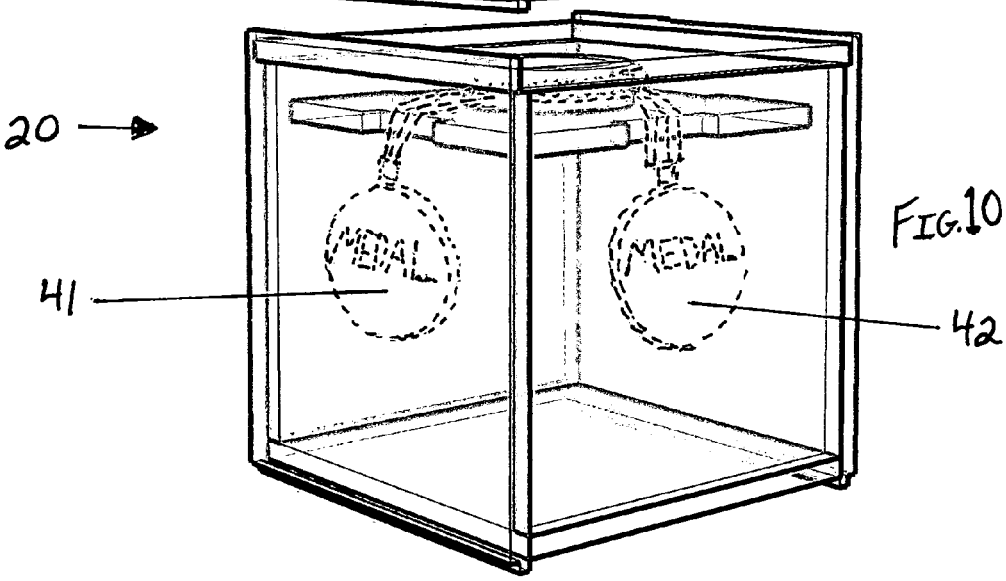
FIG. 10 is a corner perspective view of the display case for ribbon suspended medal(s) shown below and in relation to additional present invention when used as vertical expansion of the entirety of display for ribbon suspended medal(s).

FIG. 9 item 20 shows present invention in position to be stacked on FIG. 10 item 20 in vertical expanded display. FIG. 10 items 41 and 42 show supplied ribbon suspended medals which have been wound, bound, and/or affixed to the spacer hanger sheet of the lid.

The ribbon suspended medal(s) can be wound, bound, and/or affixed to the spacer area of the lid in a multitude of ways. For example, the lid is removed from the case and the ribbon can be wound around the spacer of the lid in a clockwise or counterclockwise direction until the suspended medal attached to the ribbon is allowed to hang freely over the edge of one of the cutout notches on either side of the lower sheet/hanger sheet of the lid. At this point the lid is lifted and gently placed back on top of the case with the medal(s) suspended by the lid and with the medal(s) 40, 41, 42 hanging inside the void area of the case. Other methods include wrapping, crossing over, binding, etc. on or to or around the lower sheet/hanger sheet and/or spacer in a manner that is securely and attractively displayed.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A display case for ribbon suspended medal(s) comprising:

a case or box-like structure with at least three walls chosen from a front wall, a back wall, a bottom wall, and two side walls but without a top wall thereby creating an accessible void area, said walls defining ledges at a top of said case; and a multiple component lid structure comprising a top layer and a lower layer connected together by a spacer, so as to form a void between the top and lower layers and around the spacer, the lower layer defining one or more notched areas, top layer resting on said ledges to keep the lid from dropping into the void area, with said void between said layers defining a space for the ribbon to be wound, bound, or otherwise affixed; and a component composition either partially or entirely made from transparent materials for either or both the case and the lid.

2. The case of claim 1 wherein top and bottom edges of at least two of the front wall, back wall, and side walls, have raised features to facilitate stacking of one case upon another.

* * * * *